US006320548B1

(12) United States Patent
Harrell et al.

(10) Patent No.: US 6,320,548 B1
(45) Date of Patent: Nov. 20, 2001

(54) DUAL DISK ACTIVE ANTENNA

(75) Inventors: Daniel W. Harrell, Bellingham, WA (US); Pamela R. Wallace, Lost Creek, WV (US)

(73) Assignee: Integral Technologies, Inc., Bellingham, WA (US)

( * ) Notice: Subject to any disclaimer, the term of this patent is extended or adjusted under 35 U.S.C. 154(b) by 0 days.

(21) Appl. No.: 09/771,423

(22) Filed: Jan. 26, 2001

Related U.S. Application Data

(60) Provisional application No. 60/178,542, filed on Jan. 26, 2000.

(51) Int. Cl.[7] ..... H01Q 1/38

(52) U.S. Cl. ..... 343/700 MS; 343/725; 343/770

(58) Field of Search ..... 343/700 MS, 725, 343/729, 769, 770, 829, 830, 846, 853; H01Q 1/38

(56) References Cited

U.S. PATENT DOCUMENTS

| | | | | |
|---|---|---|---|---|
| 4,947,180 | | 8/1990 | Schotz | 343/743 |
| 5,138,330 | | 8/1992 | Lindenmeier et al. | 343/713 |
| 5,181,042 | * | 1/1993 | Kaise et al. | 343/700 MS |
| 5,243,353 | * | 9/1993 | Nakahara et al. | 343/700 MS |
| 5,646,634 | * | 7/1997 | Bokhari et al. | 343/700 MS |
| 5,675,346 | * | 10/1997 | Nishikawa et al. | 343/700 MS |
| 5,714,965 | | 2/1998 | Taguchi | 343/866 |
| 5,754,142 | | 5/1998 | Wine | 343/744 |
| 5,854,480 | | 12/1998 | Noto | 235/492 |
| 5,864,318 | * | 1/1999 | Cosenza et al. | 343/700 MS |
| 5,973,644 | * | 10/1999 | Haneishi et al. | 343/700 MS |
| 5,973,650 | | 10/1999 | Nakanishi | 343/742 |
| 5,982,326 | | 11/1999 | Chow et al. | 342/365 |
| 6,252,556 | * | 6/2001 | Ito et al. | 343/770 |

* cited by examiner

*Primary Examiner*—Tho G. Phan
(74) *Attorney, Agent, or Firm*—George O. Saile; Stephen B. Ackerman; Larry J. Prescott

(57) ABSTRACT

An antenna that can be used as an active receiving antenna and a transmitting antenna is formed by forming dual disk antenna elements. The dual disk antenna elements are formed by etching a pattern in a layer of conducting material, such as copper, formed on a substrate of dielectric material. One of the disks acts as the active antenna element and the other disk acts as a counterpoise antenna element. In one embodiment a RF amplifier chip is used to form an active receiving antenna. In another embodiment the RF amplifier chip is removed and the antenna can be used either as a receiving antenna or a transmitting antenna. In another embodiment a RF amplifier chip is used with an electronic switch to include the RF amplifier chip when the antenna is used as a receiving antenna and to switch the RF chip out of the circuit when the antenna is used as a transmitting antenna.

22 Claims, 9 Drawing Sheets

DUAL DISK ACTIVE ANTENNA

This Patent Application is based on a Provisional Patent Application, filed Jan. 26, 2000, Ser. No. 60/178,542 entitled "DUAL DISK ACTIVE ANTENNA", by the same Inventors.

BACKGROUND OF THE INVENTION (1) Field of the Invention

This invention relates to an antenna system comprising a dual disk antenna and a radio frequency amplifier integrated circuit chip that can be operated as a receiving antenna or as a transmitting antenna. The optimum application frequency is determined by the disk circumference with frequency and impedance fine-tuned by the relative spacings between the two disks.

(2) Description of the Related Art

U.S. Pat. No. 5,982,326 to Chow et al. describes an active microwave antenna that includes a two-part micropatch antenna that receives signals having a first circular polarization and transmits signals having the opposite circular polarization.

U.S. Pat. No. 5,973,650 to Nakanishi describes an antenna apparatus comprising a printed circuit board, a first loop antenna, and a second loop antenna.

U.S. Pat. No. 4,947,180 to Schotz describes an antenna assembly for receiving FM signals.

U.S. Pat. No. 5,754,142 to Wine describes a high frequency antenna system using parallel conductors with a single conductor and supporting materials.

U.S. Pat. No. 5,854,480 to Noto describes a system having an integrated circuit capacitively coupled to an antenna.

U.S. Pat. No. 5,714,965 to Taguchi describes an active receiving antenna with a coplanar waveguide having a high actual gain in a frequency band as broad as 100% or more of the central frequency.

U.S. Pat. No. 5,138,330 to Lindenmeier et al. describes an active window pane antenna for use in motor vehicles.

SUMMARY OF THE INVENTION

Antenna systems that are low cost and easy to fabricate can be used in a wide range of applications. These antenna systems can be transmitting or receiving antenna systems. Often the antenna systems are used with an RF (radio frequency) amplifier integrated circuit chip to form an active antenna system. The antenna is positioned as a part of the counterpoise element of the antenna system.

It is a principal objective of this invention to provide an active receiving antenna comprising dual disk antenna elements and an RF amplifier integrated circuit chip that is mounted directly on the counterpoise element of the antenna system and becomes an integral part of the antenna itself.

It is another principal objective of this invention to provide a transmitting or receiving antenna comprising dual disk antenna elements. These disks are oriented to each other in such a manner that the relationships of the radiating element to the counterpoise element provides the capacitive and inductive relationship that provides the required 50 ohm match.

It is another principal objective of this invention to provide an antenna comprising dual disk antenna elements that can be electronically switched between a transmitting antenna and an active receiving antenna using a RF amplifier chip.

These objectives are achieved by using dual disk antenna elements which are formed by etching a pattern in a layer of conducting material, such as copper or aluminum, formed on a substrate of dielectric material. One of the disks acts as the active antenna element and the other disk acts as a counterpoise antenna element. In one embodiment a RF amplifier chip, mounted directly on the counterpoise element, is used to form an active receiving, dual-disk antenna. In another embodiment a RF amplifier chip is used with an electronic switch to activate the RF amplifier chip when the antenna is used as a receiving antenna and to switch the RF chip out of the circuit when the antenna is used as a transmitting antenna. In this second embodiment the RF amplifier and the electronic switch are both mounted on the counterpoise element disk as in the first embodiment.

DESCRIPTION OF THE PREFERRED EMBODIMENTS

Figure 1A:
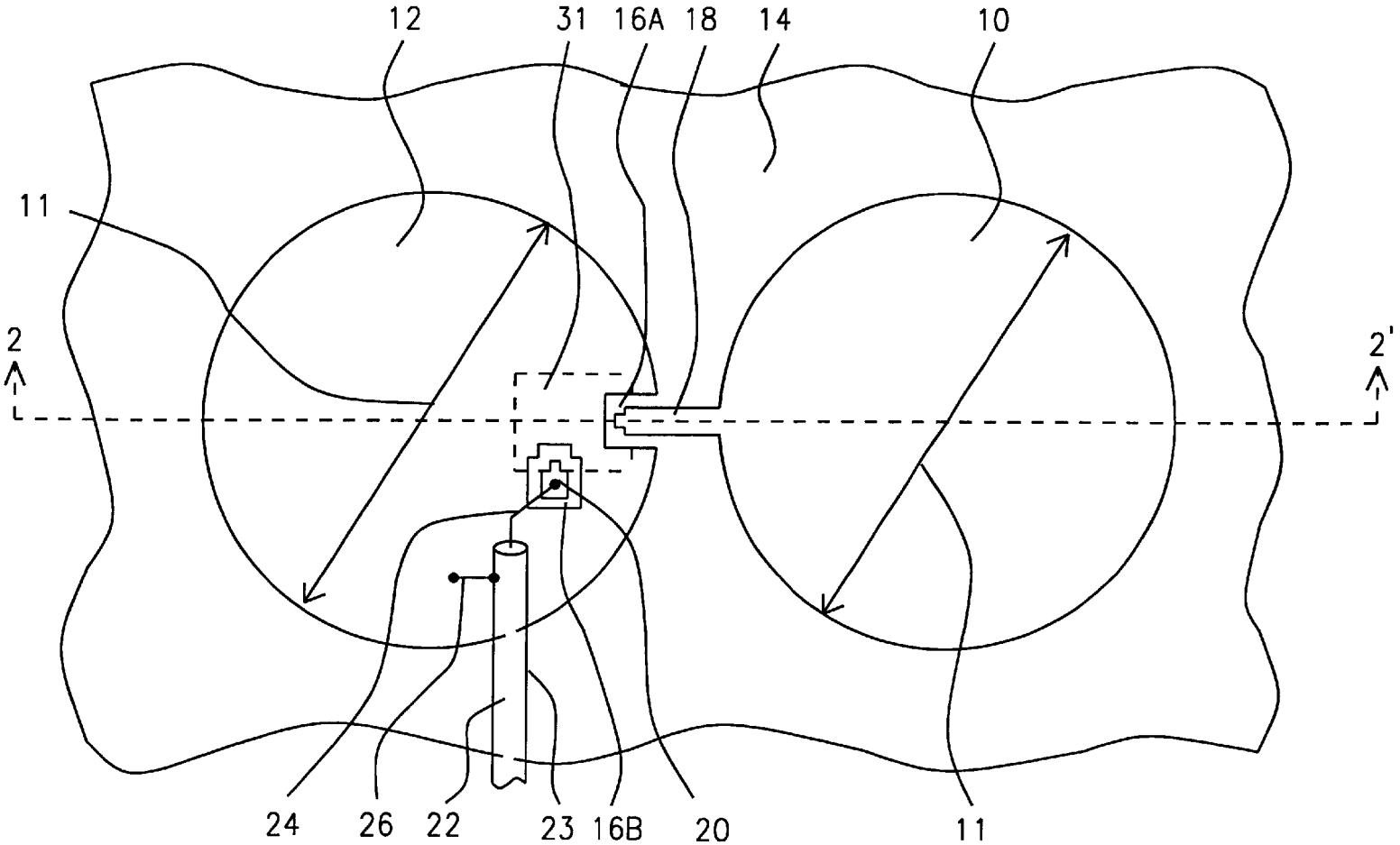
FIG. 1A shows a top view of the active receiving antenna of this invention showing the outline of the RF amplifier chip.

Refer now to FIGS. 1A–1C and 2 for a detailed description of the preferred embodiment of the active receiving antenna of this invention. FIG. 1A shows a top view of the dual disk antenna of this invention. The dual disk antenna has a first antenna element 10, which is the radiating antenna element, and a second antenna element 12, which is a counterpoise antenna element. The first antenna element 10 and the second antenna element 12 are circular and have the same diameter 11. The first antenna element 10 and the second antenna element 12 are formed of a conducting material, such as copper or aluminum, formed on a dielectric substrate.

As shown in FIG. 1A, the second antenna element 12 has the conducting material removed from a first isolation region 16A located at the outer periphery of the second antenna element 12. The second antenna element 12 also has the conducting material removed from a second isolation region 16B located within the outer periphery of the second antenna element 12. A first contact element 18 is formed of the conducting material on the dielectric substrate, wherein the first contact element 18 makes electrical contact with the first antenna element 10 and extends into the first isolation region 16A. The first contact element 18 does not make electrical contact with the second antenna element. A second contact element 20, also formed of the conducting material on the dielectric substrate is located within the second isolation region 16B but does not make electrical contact with the second antenna element 12.

Figure 1B:
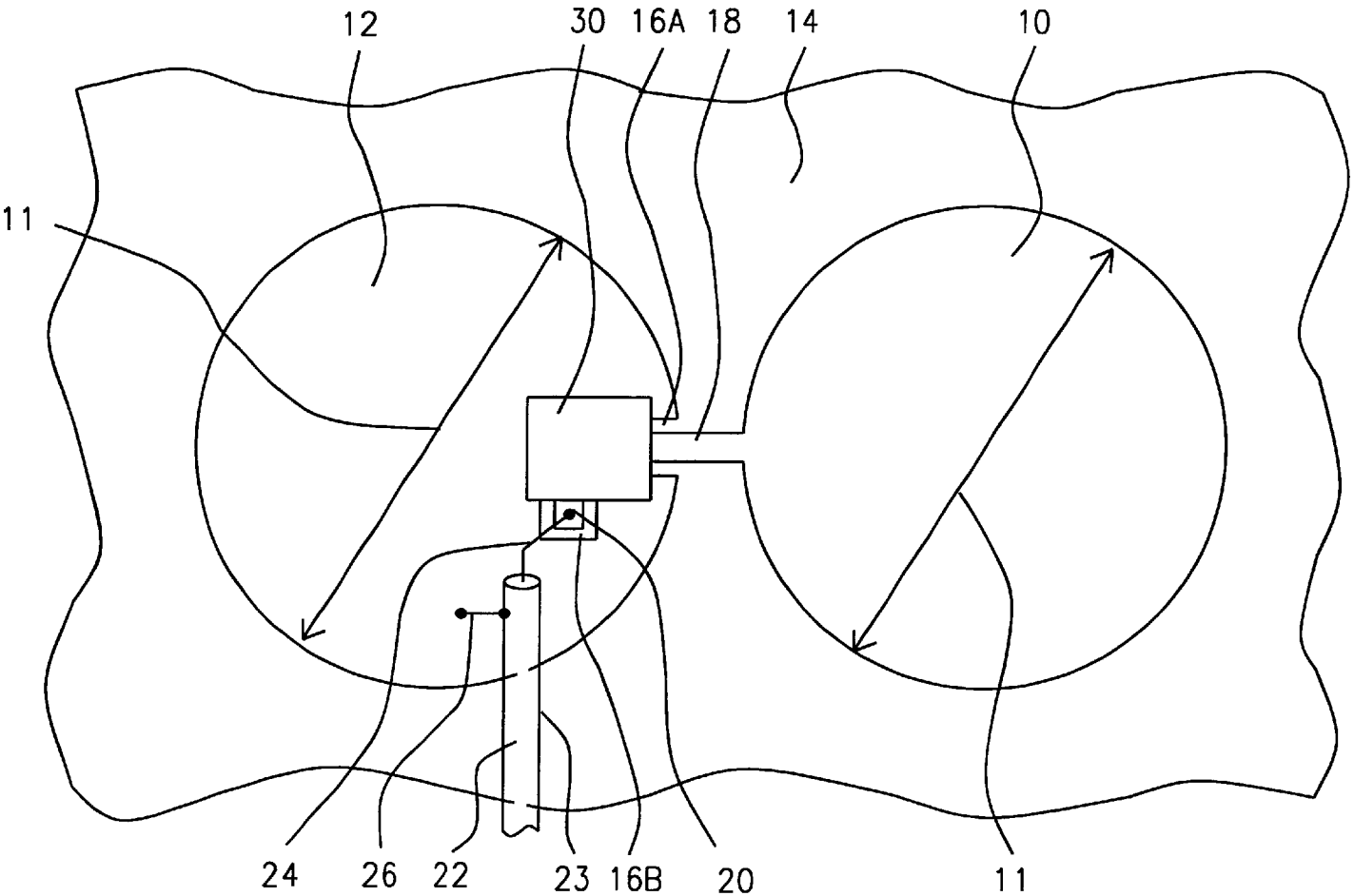
FIG. 1B shows a top view of the active receiving antenna of this invention showing the RF amplifier chip mounded face down, or flip chip mounted, over the counterpoise antenna disk element.
Figure 1C:
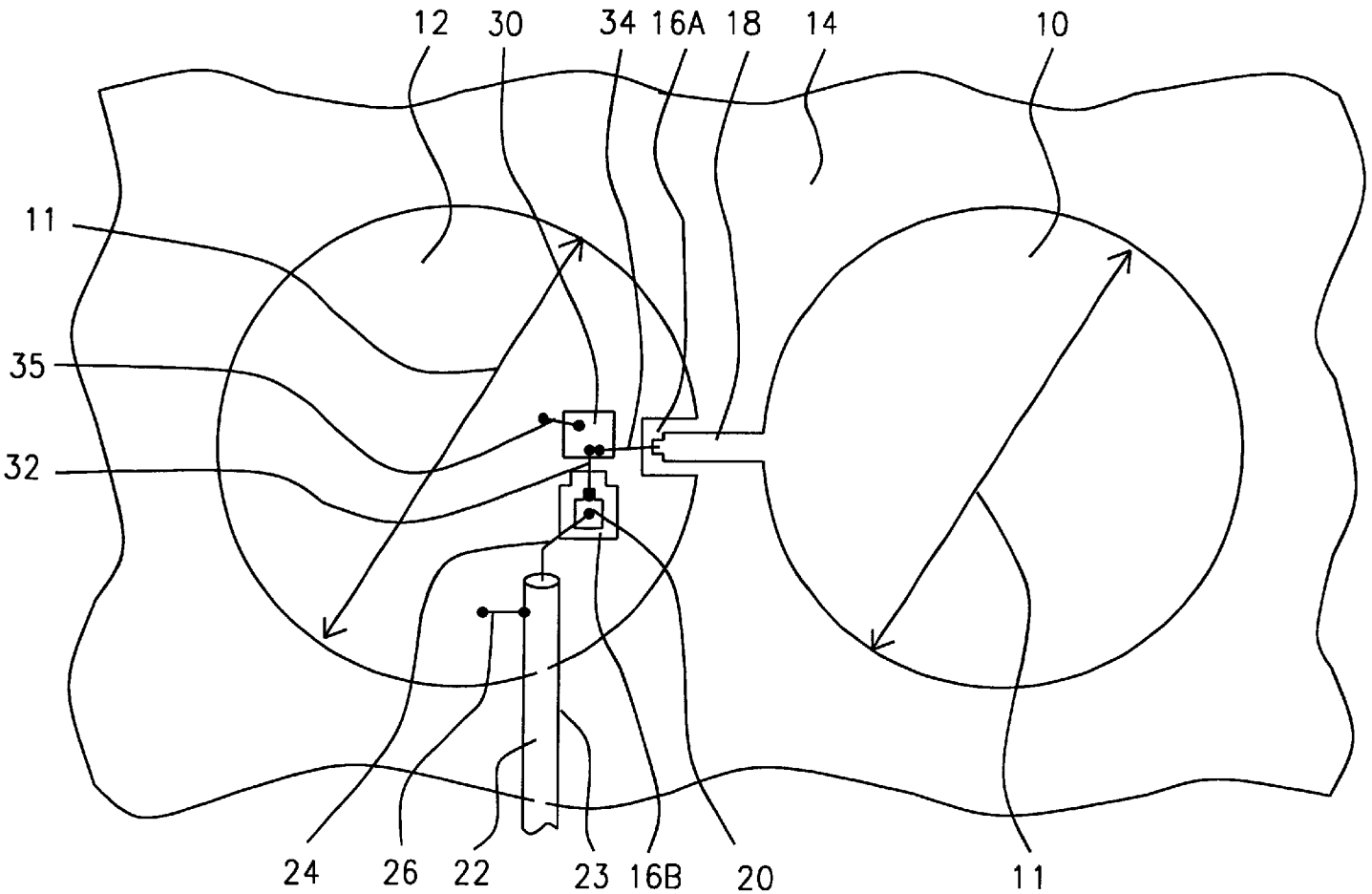
FIG. 1C shows a top view of the active receiving antenna of this invention showing the RF amplifier chip mounded back down on one of the antenna disk elements.
Figure 2:
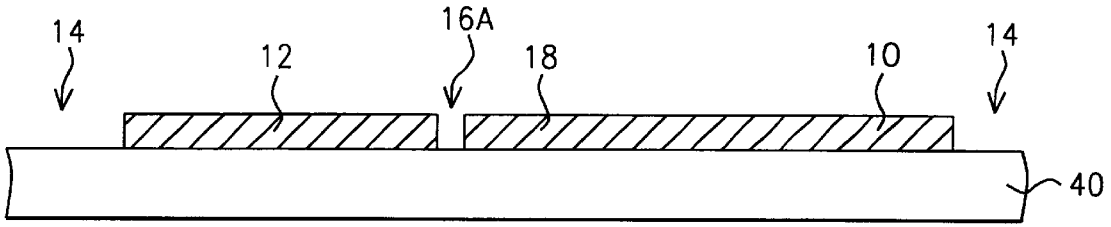
FIG. 2 shows a cross section view of the dual disk antenna of this invention.

As shown in FIG. 2, the antenna is formed from conducting material, such as copper, aluminum, or the like, on a dielectric substrate 40. A pattern is etched in the conducting material to form the isolation regions, antenna elements, and contact elements. In FIGS. 1A–1C and 2 of this description the same reference numbers are used to identify the same features.

Referring again to FIG. 1A, a RF amplifier chip having an input pad, an output pad, and a ground pad, is used to achieve an amplified antenna signal. The dashed line 31 indicates the position of the RF amplifier chip. The input pad of the RF amplifier chip is electrically connected to the first contact element 18 and thereby electrically connected to the first antenna element 10. The output pad of the RF amplifier chip is electrically connected to the second contact element 20 and the ground pad is electrically connected to the second antenna element 12. A coaxial cable 22, having a center conductor 24 and an outer conductor 23 is used to conduct the RF signal from the amplifier. The center conductor 24 of the coaxial cable 22 is electrically connected to the second contact element 20 and thereby to the output pad of the RF amplifier chip. The outer conductor 23 of the coaxial cable 20 is electrically connected to the second antenna element 12.

FIG. 1B shows the antenna of FIG. 1A with the RF amplifier chip 30 mounted face down, or flip chip mounted. The input pad of the RF amplifier chip 30 is physically and electrically connected to the first contact element 18 and thereby electrically connected to the first antenna element 10. The output pad of the RF amplifier chip 30 is physically and electrically connected to the second contact element 20 and thereby to the center conductor 24 of the coaxial cable 22. The ground pad of the RF amplifier chip 30 is physically and electrically connected to the second antenna element 12, and thereby to the outer conductor 23 of the coaxial cable 22. The input, output, and ground pads of the RF amplifier chip 30 are not shown because they are between the RF amplifier chip 30 and the second antenna element 12.

FIG. 1C shows the antenna of FIG. 1A showing the RF amplifier chip 30 mounted back down on the second antenna element 12. The input pad of the RF amplifier chip 30 is electrically connected to the first contact element 18 using a wire bond 34, and thereby electrically connected to the first antenna element 10. The output pad of the RF amplifier chip 30 is electrically connected to the second contact element 20 using a wire bond 32, and thereby to the center conductor 24 of the coaxial cable 22. The ground pad of the RF amplifier chip 30 is electrically connected to the second antenna element 12 using a wire bond 35, and thereby to the outer conductor 23 of the coaxial cable 22. To minimize the effects of the coaxial cable 22 on the performance of the antenna, the coaxial cable placement is perpendicular to a line between the centers of the two disks, thereby minimizing the region of the second antenna element 12 that the coaxial cable traverses.

The circumference of each of the antenna elements is made to three quarters of a wavelength of the intended frequency. In this example the center frequency of interest is about 1.575 GHz which means the circumference must be about 5.3 inches. In the preferred implementation the actual diameter is 1.6 inches resulting in a disc circumference of 5.2 inches. The antenna may be further tuned to 50 ohms by adjusting the spacing between the two antenna elements.

Figure 3:
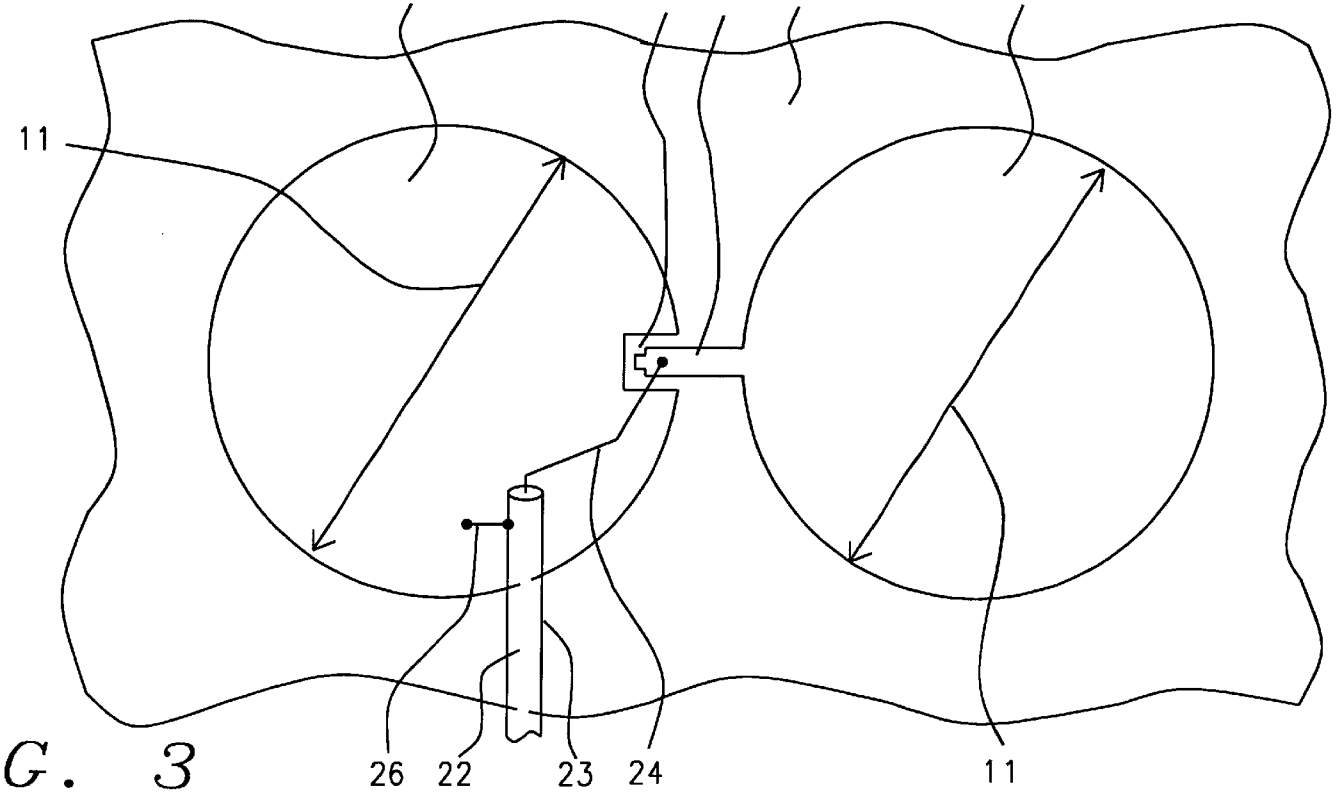
FIG. 3 shows a top view of the dual disk transmitting antenna of this invention with conducting material removed to form isolation regions that determine the radiating element and the counterpoise with no amplifier region isolated.

Refer now to FIG. 3 for a detailed description of a preferred embodiment of the receiving and transmitting antenna of this invention. The key difference between the antenna of this embodiment and the antenna of the previous embodiment is that the RF amplifier chip has been removed. FIG. 3 shows top view of the dual disk receiving antenna of this embodiment. The dual disk receiving antenna has a first antenna element 10, which is the active antenna element, and a second antenna element 12, which is a counterpoise antenna element. The first antenna element 10 and the second antenna element 12 are circular and have the same diameter 11. The first antenna element 10 and the second antenna element 12 are formed of a conducting material, such as copper or aluminum, formed on a dielectric substrate.

As shown in FIG. 3, the second antenna element 12 has the conducting material removed from a first isolation region 16A located at the outer periphery of the second antenna element 12. FIG. 3 shows the case where the second isolation region of the previous embodiment is not formed. A first contact element 18 is formed of the conducting material on the dielectric substrate, wherein the first contact element 18 makes electrical contact with the first antenna element 10 and extends into the first isolation region 16A. The first contact element 18 does not make electrical contact with the second antenna element.

As shown in FIG. 3 the two disks forming the first antenna element 10 and the second antenna element 12 are formed by etching away the conducting material around the disks forming the first antenna element 10 and second antenna element 12. There is only dielectric in the region 14 around the disks forming the first antenna element 10 and second antenna element 12.

As in the previous embodiment and shown in FIG. 2, the antenna is formed from conducting material, such as copper, aluminum, or the like, on a dielectric substrate 40. A pattern is etched in the conducting material to form the isolation regions, antenna elements, and contact elements. In FIG. 3 of this description the same reference numbers are used to identify the same features.

A coaxial cable 22, having a center conductor 24 and an outer conductor 23 is used to transmit the RF signal from the antenna in the case of a receiving antenna and to transmit the RF signal to the antenna in the case of a transmitting antenna. The center conductor 24 of the coaxial cable 22 is electrically connected to the first contact element 18 and thereby to the first antenna element 10. The outer conductor 23 of the coaxial cable 22 is electrically connected to the second antenna element 12.

Figure 4A:
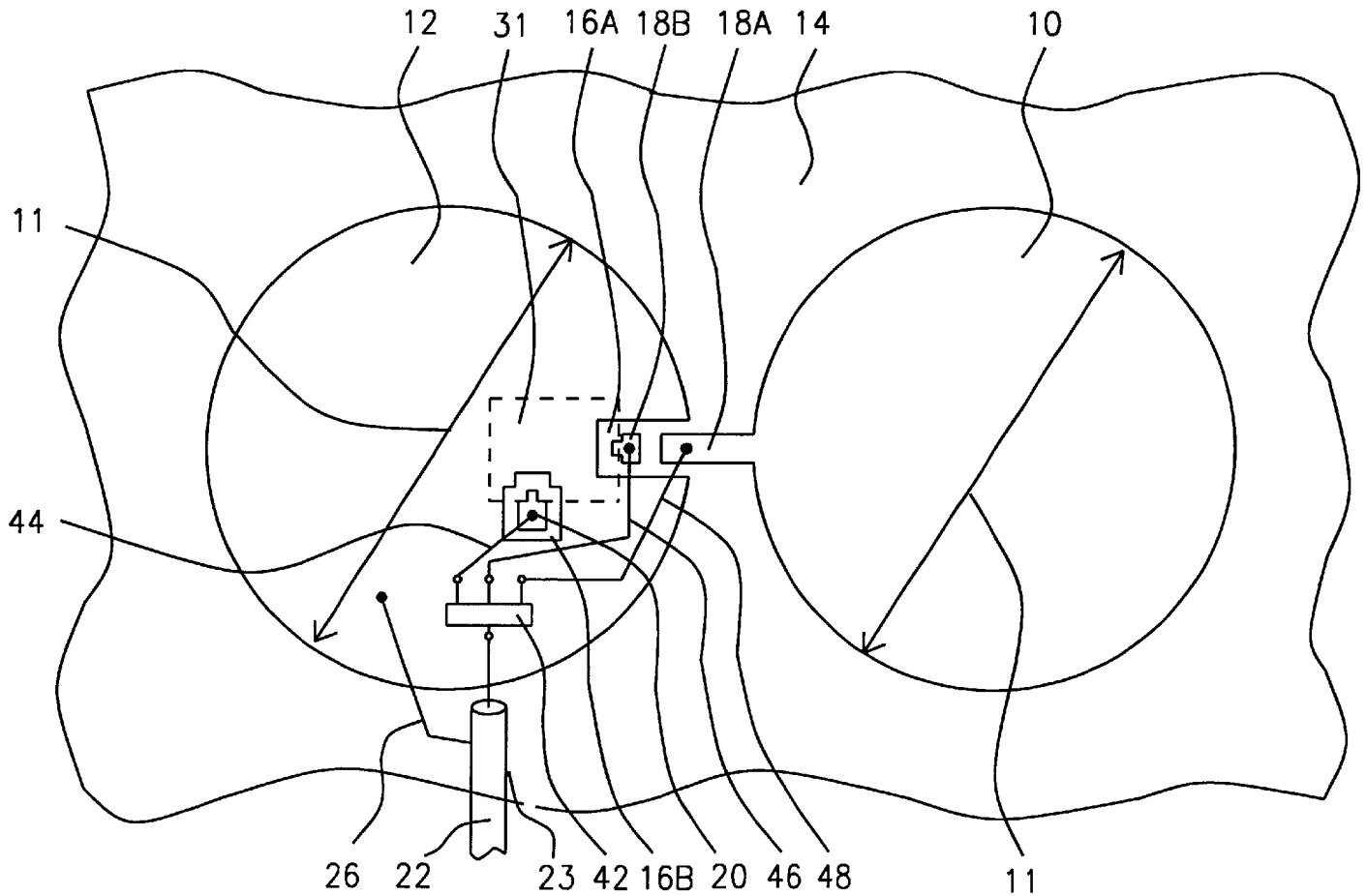
FIG. 4A shows a top view of the antenna of this invention using an electronic switch to switch between a transmitting antenna and an active receiving antenna and also showing the outline for installation of the RF amplifier chip.
Figure 4B:
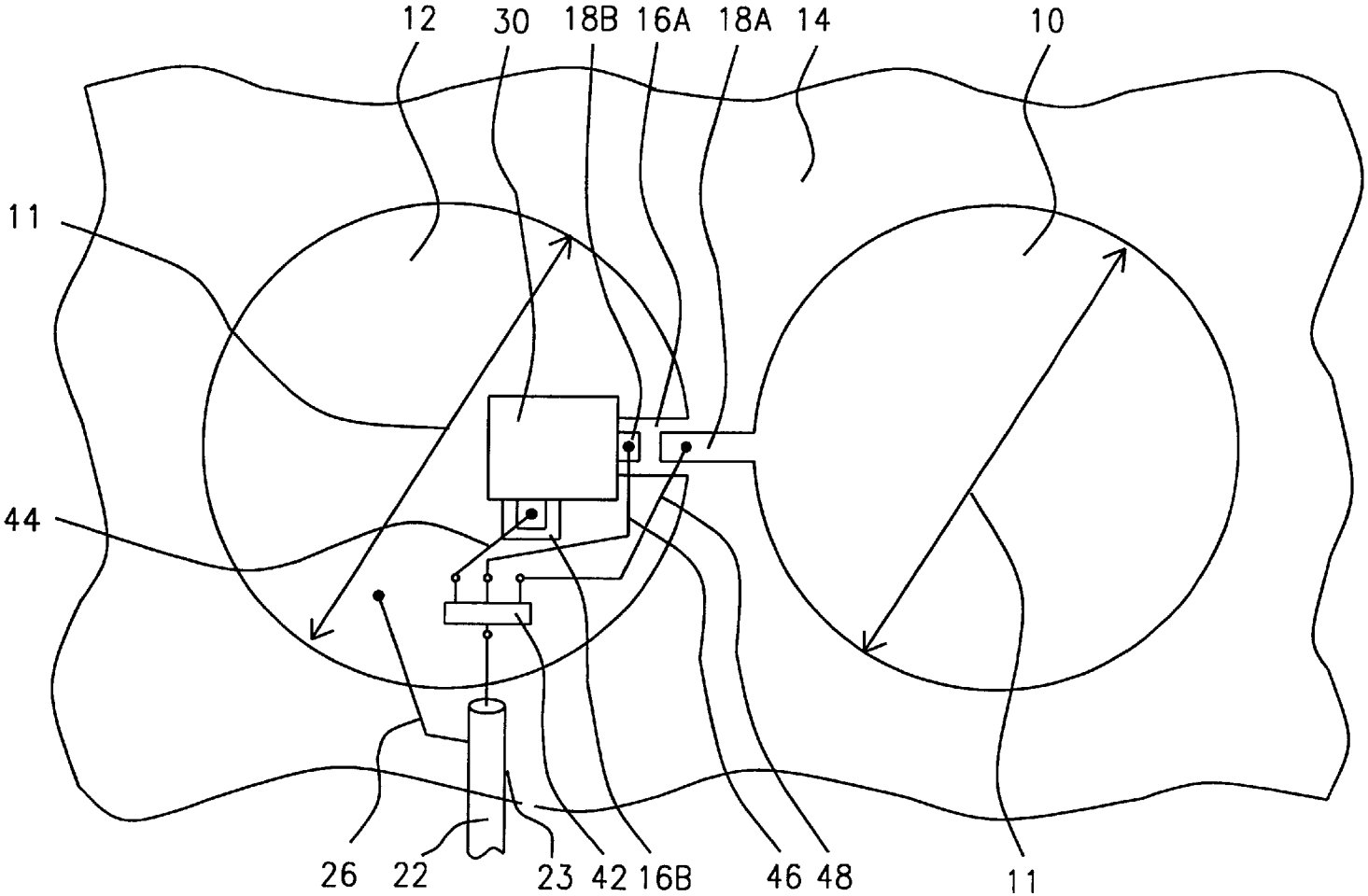
FIG. 4B shows a top view of the antenna of this invention using an electronic switch to switch between a transmitting antenna and an active receiving antenna showing the RF amplifier chip mounted face down, or flip chip mounted.
Figure 4C:
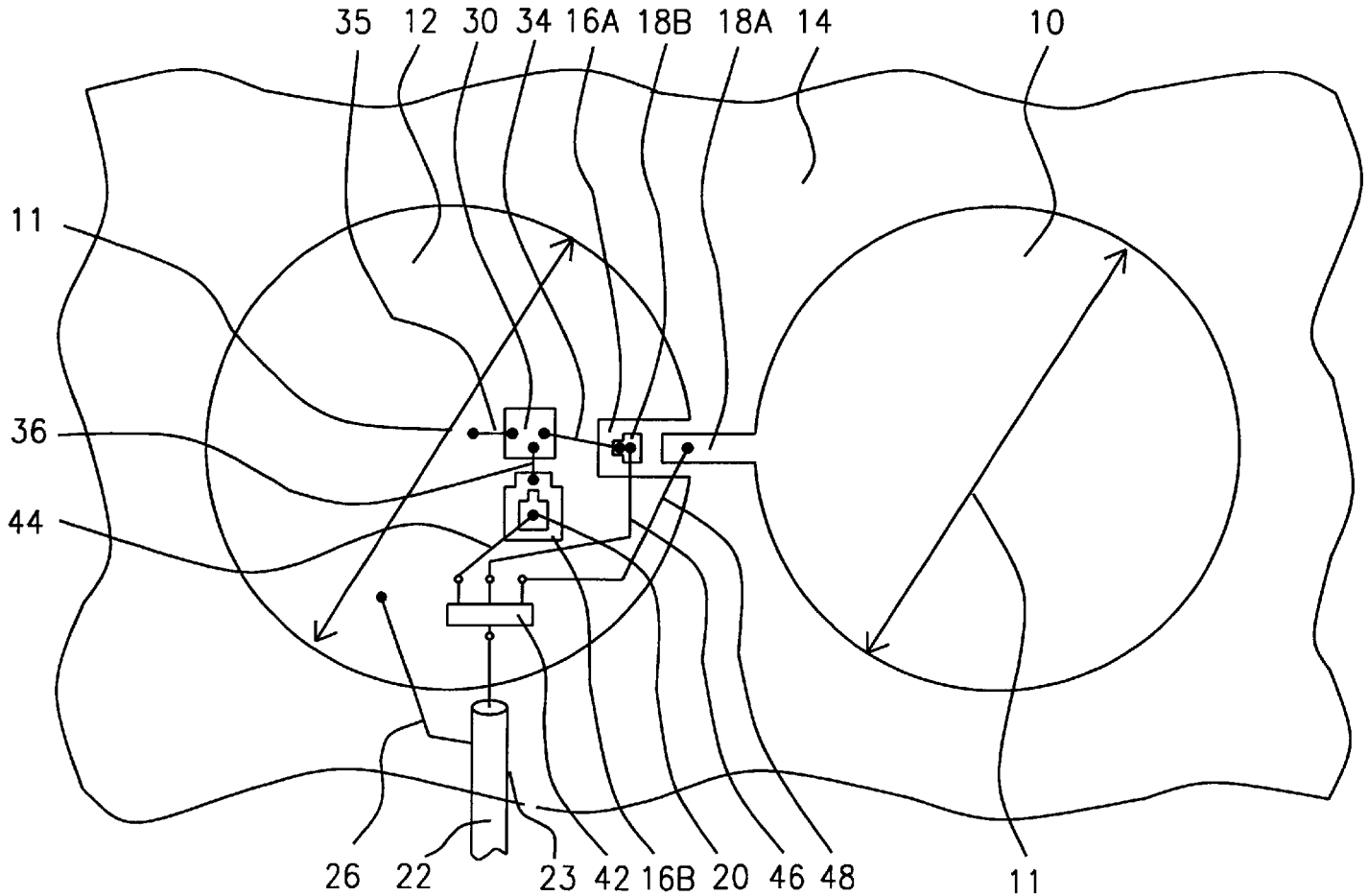
FIG. 4C shows a top view of the antenna of this invention using an electronic switch to switch between a transmitting antenna and an active receiving antenna showing the RF amplifier chip mounded back down.

Refer now to FIGS. 4A–4C for a detailed description of the preferred embodiment of the active receiving antenna and transmitting antenna of this invention. FIG. 4A shows a top view of the dual disk antenna of this invention. The dual disk antenna has a first antenna element 10, which is the active antenna element, and a second antenna element 12, which is a counterpoise antenna element. The first antenna element 10 and the second antenna element 12 are circular and have the same diameter 11. The first antenna element 10 and the second antenna element 12 are formed of a conducting material, such as copper or aluminum, formed on a dielectric substrate.

As shown in FIG. 4A, the second antenna element 12 has the conducting material removed from a first isolation region 16A located at the outer periphery of the second antenna element 12. The second antenna element 12 also has the conducting material removed from a second isolation region 16B located within the outer periphery of the second antenna element 12. A first contact element 18A is formed of the conducting material on the dielectric substrate, wherein the first contact element 18A makes electrical contact with the first antenna element 10 and extends into the first isolation region 16A. In this embodiment a third contact element 18B is also formed in the first isolation region 16A. Neither the first contact element 18A nor the third contact element 18B make electrical contact with the second antenna element. A second contact element 20, also formed of the conducting material on the dielectric substrate is located within the second isolation region 16B but does not make electrical contact with the second antenna element 12. As shown in FIG. 4A the two disks forming the first antenna element 10 and the second antenna element 12 are formed by etching away the conducting material outside the two disks leaving a region 14 of only dielectric material.

As shown in FIG. 2, the antenna is formed from conducting material, such as copper, aluminum, or the like, on a dielectric substrate 40. A pattern is etched in the conducting material to form the isolation regions, antenna elements, and contact elements. In the FIGS. 4A–4C of this description the same reference numbers are used to identify the same features.

Referring again to FIG. 4A, a RF amplifier chip having an input pad, an output pad, and a ground pad, is used to achieve an active receiving antenna. The dashed line 31 indicates the position of the RF amplifier chip. The RF amplifier chip must be included in the antenna circuit when the antenna is used as an active receiving antenna and must be removed form the circuit when the antenna is used as a transmitting antenna. An electronic switch 42 accomplishes this. The input pad of the RF amplifier chip is electrically connected to the third contact element 18B. The output pad of the RF amplifier chip is electrically connected to the second contact element 20 and the ground pad is electrically connected to the second antenna element 12.

A coaxial cable 22, having a center conductor 24 and an outer conductor 23 is used to extract the RF signal from the antenna when used as an active receiving antenna and to deliver power to the antenna when used as a transmitting antenna. The center conductor 24 of the coaxial cable 22 is electrically connected to the primary contact of the electronic switch 42. The outer conductor 23 of the coaxial cable 20 is electrically connected to the second antenna element 12. A first secondary contact 44 of the electronic switch 42 is connected to the second contact element 20 and thereby to the output pad of the RF amplifier chip. A second secondary contact 46 of the electronic switch 42 is connected to the third contact element 18B, and thereby to the input pad of the RF amplifier chip. A third secondary contact 48 of the electronic switch is connected to the first contact element 18A and thereby to the first antenna element 10.

When the antenna is used as an active receiving antenna the electronic switch 42 connects its primary contact to the first secondary contact 44 and the second secondary contact 46 to the third secondary contact 48 of the electronic switch 42. This connects the center conductor 24 of the coaxial cable 22 to the output pad of the RF amplifier chip and the first antenna element 10 to the input pad of the RF amplifier chip. This allows the coaxial cable to extract an RF signal from the active receiving antenna.

When the antenna is used as a transmitting antenna the electronic switch 42 connects its primary contact to the third secondary contact 48 of the electronic switch 42 and leaves the first secondary contact 44 and second secondary contact 46 of the electronic switch 42 floating or connected to an AC ground. This connects the center conductor 24 of the coaxial cable 22 to the first antenna element 10 allowing the coaxial cable to deliver power to the antenna, and removes the RF amplifier chip from the antenna circuit when the antenna is used as a transmitting antenna.

FIG. 4B shows the antenna of FIG. 1A showing the RF amplifier chip 30 mounted face down, or flip chip mounted. The input pad of the RF amplifier chip 30 is physically and electrically connected to the third contact element 18B and thereby to the second secondary contact 46 of the electronic switch 42. The output pad of the RF amplifier chip 30 is physically and electrically connected to the second contact element 20 and thereby to the first secondary contact 44 of the electronic switch 42. The ground pad of the RF amplifier chip 30 is physically and electrically connected to the second antenna element 12. The input, output, and ground pads of the RF amplifier chip 30 are not shown because they are between the RF amplifier chip 30 and the second antenna element 12.

FIG. 4C shows the antenna of FIG. 1A showing the RF amplifier chip 30 mounted back down on the second antenna element 12. The input pad of the RF amplifier chip 30 is electrically connected to the third contact element 18B using a wire bond 34, and thereby electrically connected to the second secondary contact 46 of the electronic switch 42. The output pad of the RF amplifier chip 30 is electrically connected to the second contact element 20 using a wire bond 32, and thereby to the first secondary contact 44 of the electronic switch 42. The ground pad of the RF amplifier chip 30 is electrically connected to the second antenna element 12 using a wire bond 35. The circumference of the first antenna element is adjusted to be equal to three quarters of a wavelength of the center frequency of interest.

Figure 5A:
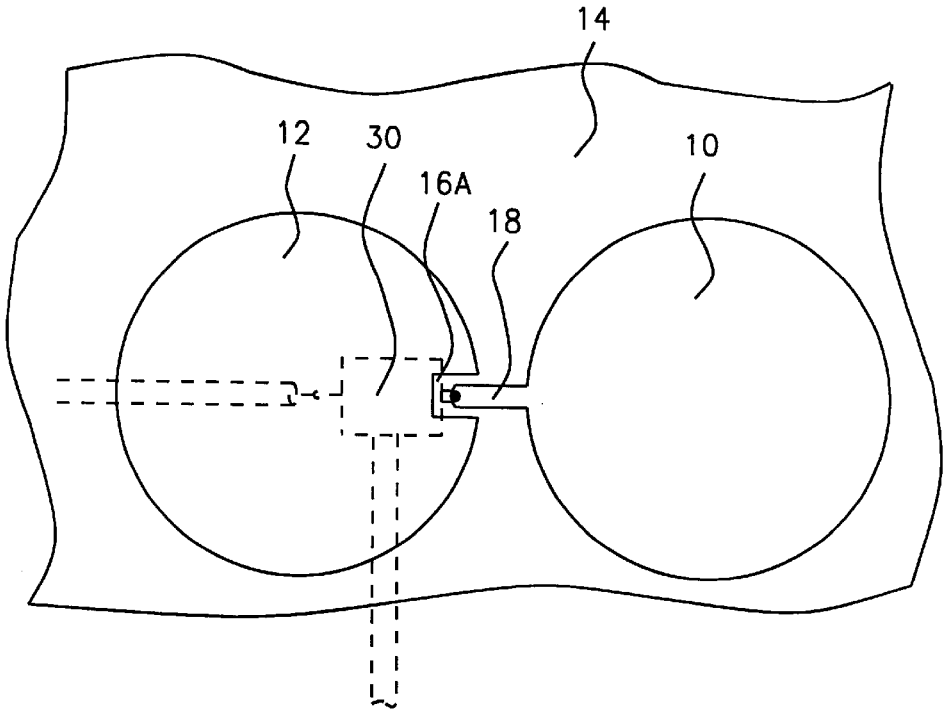
FIGS. 5A, 5B, and 6 show the concept of locating the RF amplifier and switch below the counterpoise antenna disk with connections to the antenna element through vias.
Figure 5B:
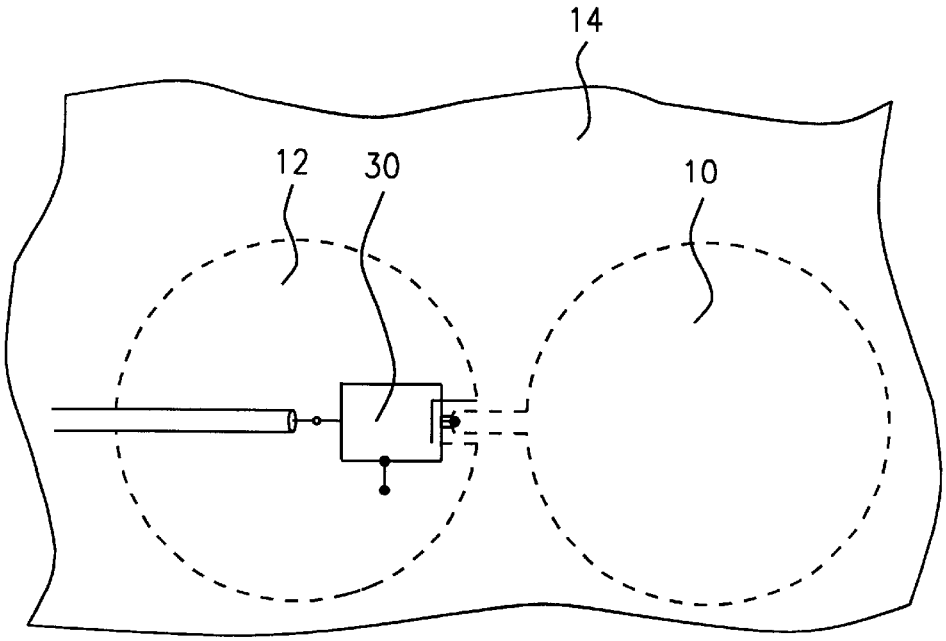
Figure 6:
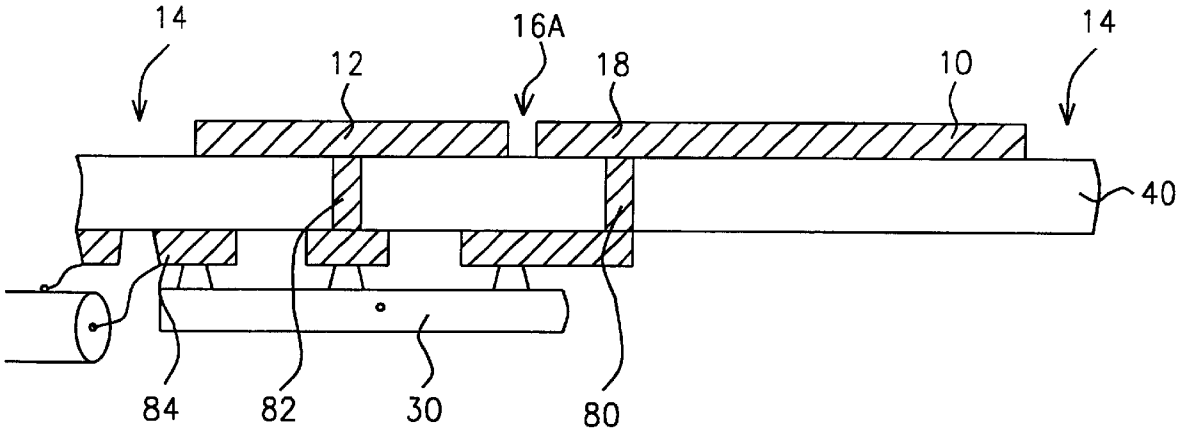

FIGS. 5A, 5B, and 6 show the option of locating the amplifier 30 on the opposite side of the dielectric from the antenna conducting layers. The amplifier connection to the input connection 18 to the active antenna element 10 is realized with a via 80. The amplifier 30 is located beneath the counterpoise antenna element 12. The conducting counterpoise antenna element 12 helps shield the antenna from external RF signals. The via provides a very short, low loss path from the active antenna element 10 to the amplifier. It is also possible to introduce ground vias surrounding the signal via to the amplifier to further isolate the signal path from external RF noise. The amplifier ground is connected to the counterpoise antenna element 12 with a via 82. The amplifier output pad 84 is connected to the center lead of a coaxial cable or a prinyed circuit transmission line. The coaxial cable ground connection is connected to the counterpoise antenna using a via.

In FIG. 6 the amplifier chip is shown as a chip with solder bump connections. Those skilled in the art will readily recognize that the amplifier could be enclosed in a standard integrated circuit package where the signal and ground leads connect to the active antenna element, coaxial cable center lead, and ground in a similar manner.

Figure 7:
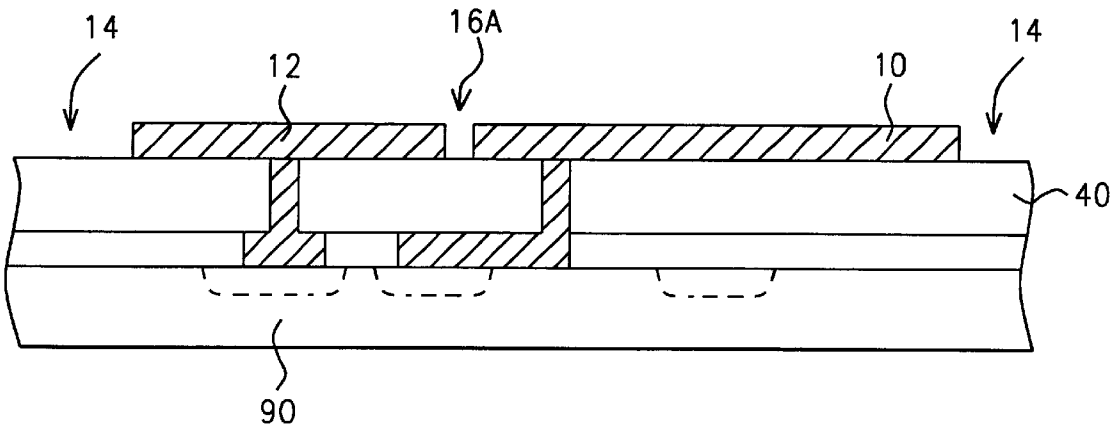
FIG. 7 shows the concept of the dual disk antenna being implemented on an integrated circuit wiring layer with the amplifier and switch circuits being contained in the silicon below the wiring layers.

FIG. 7 shows the case where the active antenna element 10 and counterpoise antenna element 12 are formed on the top conducting layers of an integrated circuit chip. The amplifier is formed with active and passive devices in the semiconductor 90 and their respective interconnect layers. In a number of high performance communications applications, in particular wireless applications, the top interconnect layer is relatively thick with very low losses and the first dielectric layer 40 beneath this top conducting layer is relatively thick with very low losses isolating the top layer more effectively from the interconnect wiring below. This type of structure enables the implementation of the dual disk structure on the top conductor layer, the amplifier in the silicon 90, and a transmission line of interconnect layers as means to connect to external elements. Due to scaling the integrated circuit version would operate at a significantly higher frequency than the circuit board version.

Placing the dual disc antennas described herein a fixed distance above a ground plane will enhance the antenna performance. The fixed distance is a function of the application frequency wavelength.

While the invention has been particularly shown and described with reference to the preferred embodiments thereof, it will be understood by those skilled in the art that various changes in form and details may be made without departing from the spirit and scope of the invention.

What is claimed is:

1. An antenna, comprising:

a first antenna element formed of conducting material on a dielectric substrate, wherein said first antenna element is a circular disk having a diameter;

a second antenna element formed of said conducting material on said dielectric substrate, wherein said second antenna element is a circular disk having the same diameter as said first antenna element, said second antenna element has said conducting material removed from a first isolation region located at the outer periphery of said second antenna element, and said second antenna element has said conducting material removed from a second isolation region located within said outer periphery of said second antenna element;

a first contact element formed of said conducting material on said dielectric substrate, wherein said first contact element makes electrical contact with said first antenna element, extends into said first isolation region, and is electrically insulated from said second antenna element;

a second contact element formed of said conducting material on said dielectric substrate located within said second isolation region, wherein said second contact element is electrically insulated from said second antenna element, said first antenna element, and said first contact element;

a third isolation region providing electrical insulation between a background element and said first antenna element and said background element and said second antenna element, wherein said conducting material is removed from said third isolation region;

a coaxial cable having a center conductor and an outer conductor wherein said center conductor is electrically connected to said first contact element and said outer conductor is electrically connected to said second antenna element; and a radio frequency amplifier chip having an input pad, an output pad, and a ground pad, wherein said input pad is electrically connected to said first contact element, said output pad is electrically connected to said second contact element, and said ground pad is electrically connected to said second antenna element.

2. The antenna of claim 1 wherein the circumference of said first antenna element is equal to three quarters of the wavelength of a center frequency.

3. The antenna of claim 2 wherein said center frequency is about 1.5 gigahertz.

4. The antenna of claim 1 wherein said diameter of said first antenna element and said second antenna element is between about 1.5 and 1.7 inches.

5. The antenna of claim 1 wherein said conducting material is copper.

6. The antenna of claim 1 wherein said conducting material is aluminum.

7. The antenna of claim 1 wherein said radio frequency amplifier chip is mounted face down with said input pad forming a physical and electrical connection to said first contact element, said output pad forming a physical and electrical connection to said second contact element, and said ground pad forming a physical and electrical connection to said second antenna element.

8. The antenna of claim 1 wherein said radio frequency amplifier chip is mounded back down with wire bond electrical connections between said input pad and said first contact element, said output pad and said second contact element, and said ground pad and said second antenna element.

9. The antenna of claim 1 wherein said center conductor of said coaxial cable is use to supply direct current power to said radio frequency amplifier chip.

10. An antenna, comprising:

a first antenna element formed of conducting material on a dielectric substrate, wherein said first antenna element is a circular disk having a diameter;

a second antenna element formed of said conducting material on said dielectric substrate, wherein said second antenna element is a circular disk having the same said diameter as said first antenna element, and said second antenna element has said conducting material removed from a first isolation region located at the outer periphery of said second antenna element;

a first contact element formed of said conducting material on said dielectric substrate, wherein said first contact element makes electrical contact with said first antenna element, extends into said first isolation region, and is electrically insulated from said second antenna element;

a second isolation region providing electrical insulation between a background element and said first antenna element and said background element and said second antenna element, wherein said conducting material is removed from said second isolation region; and a coaxial cable having a center conductor and an outer conductor wherein said center conductor is electrically connected to said first contact element and said outer conductor is electrically connected to said second antenna element.

11. The antenna of claim 10 wherein the circumference of said first antenna element is equal to three quarters of the wavelength of a center frequency.

12. The antenna system of claim 10 wherein said conducting material is copper.

13. The antenna system of claim 10 wherein said conducting material is aluminum.

14. An antenna, comprising:

a first antenna element formed of conducting material on a dielectric substrate, wherein said first antenna element is a circular disk having a diameter;

a second antenna element formed of said conducting material on said dielectric substrate, wherein said second antenna element is a circular disk having the same diameter as said first antenna element, said second antenna element has said conducting material removed from a first isolation region located at the outer periphery of said second antenna element, and said second antenna element has said conducting material removed from a second isolation region located within said outer periphery of said second antenna element;

a first contact element formed of said conducting material on said dielectric substrate, wherein said first contact element makes electrical contact with said first antenna element, extends into said first isolation region, and is electrically insulated from said second antenna element;

a second contact element formed of said conducting material on said dielectric substrate located within said second isolation region, wherein said second contact element is electrically insulated from said second antenna element, said first antenna element, and said first contact element;

a third isolation region which provides electrical insulation between a background element and said first antenna element and said background element and said second antenna element, wherein said conducting material is removed from said third isolation region;

a coaxial cable having a center conductor and an outer conductor wherein said outer conductor is electrically connected to said second antenna element;

a radio frequency amplifier chip having an input pad, an output pad, and a ground pad, wherein said ground pad is electrically connected to said second antenna element; and a connecting means to connect said center conductor of said coaxial cable to said first contact element when said antenna is operating as a transmitting antenna, and to connect said center conductor of said coaxial cable to said output pad of said radio frequency amplifier chip and said first contact element to said input pad of said radio frequency amplifier chip when said antenna is operating as a receiving antenna.

15. The antenna of claim 14 wherein the circumference of said first antenna element is equal to one fourth of the wavelength of a center frequency.

16. The antenna of claim 15 wherein said center frequency is about 1.5 gigahertz.

17. The antenna of claim 14 wherein said conducting material is copper.

18. The antenna of claim 14 wherein said conducting material is aluminum.

19. The antenna of claim 14 wherein said radio frequency amplifier chip is mounted face down with said ground pad forming a physical and electrical connection to said second antenna element.

20. The antenna of claim 14 wherein said radio frequency amplifier chip is mounded back down with wire bond electrical connections between said ground pad and said second antenna element.

21. The antenna of claim 14 wherein said connecting means comprises an electronic switch.

22. The antenna of claim 14 wherein said center conductor of said coaxial cable is use to supply direct current power to said radio frequency amplifier chip.

* * * * *